US010875616B2

(12) United States Patent
Gallato et al.

(10) Patent No.: US 10,875,616 B2
(45) Date of Patent: Dec. 29, 2020

(54) TRANSMISSION FOR A MARINE OUTBOARD PROPULSION SYSTEM

(71) Applicants: ZF FRIEDRICHSHAFEN AG, Friedrichshafen (DE); ZF PADOVA SRL., Caselle di Selvazzano (IT)

(72) Inventors: Fernando Gallato, Padua (IT); Adone Bertolo, Padua (IT)

(73) Assignees: ZF FRIEDRICHSHAFEN AG, Friedrichshafen (DE); ZF PADOVA SRL., Caselle di Selvazzano (IT)

( * ) Notice: Subject to any disclaimer, the term of this patent is extended or adjusted under 35 U.S.C. 154(b) by 0 days.

(21) Appl. No.: 16/489,784

(22) PCT Filed: Jan. 23, 2018

(86) PCT No.: PCT/EP2018/051492

§ 371 (c)(1),
(2) Date: Aug. 29, 2019

(87) PCT Pub. No.: WO2018/158004

PCT Pub. Date: Sep. 7, 2018

(65) Prior Publication Data

US 2020/0115021 A1 Apr. 16, 2020

(30) Foreign Application Priority Data

Mar. 2, 2017 (DE) ..... 10 2017 203 385

(51) Int. Cl.
*B63H 21/21* (2006.01)
*B60W 10/04* (2006.01)
*B63H 20/20* (2006.01)

(52) U.S. Cl.
CPC ..... *B63H 20/20* (2013.01)

(58) Field of Classification Search
CPC ..... B63H 20/00; B63H 20/08; B63H 20/10; B63H 20/12; B63H 20/14; B63H 20/16; B63H 20/18; B63H 20/20; B63H 20/22
(Continued)

(56) References Cited

U.S. PATENT DOCUMENTS

2009/0163094 A1 6/2009 Fukuoka
2011/0124250 A1 5/2011 Matsuda et al.
(Continued)

FOREIGN PATENT DOCUMENTS

| | | |
|---|---|---|
| CH | 256 399 | 2/1949 |
| DE | 844 718 | 7/1949 |
| GB | 656155 | 8/1951 |

OTHER PUBLICATIONS

Written Opinion filed in corresponding PCT Application No. PCT/EP2018/051492 dated Apr. 13, 2018.
(Continued)

*Primary Examiner* — Daniel V Venne
(74) *Attorney, Agent, or Firm* — Davis & Bujold PLLC; Michael J. Bujold

(57) ABSTRACT

A transmission (6) for a marine outboard propulsion system (1) which comprises an input shaft (7) connectable to an engine (4), a countershaft (19) arranged parallel to the input shaft (7), several pairs of gears (15, 16; 17, 18) for transmitting rotation of the input shaft (7) to the countershaft (19) and switching elements (23, 25, 30) for selectively engaging gears (15, 16, 17, 18, 38) to enable at least two forward gear ratios and one reverse gear ratio. The transmission (6) comprises an output shaft (8) which is arranged coaxial to the input shaft (7) and a PTO countershaft (31) adapted to drive at least one PTO-aggregate (9, 10). The transmission is part of a marine outboard propulsion system.

10 Claims, 3 Drawing Sheets

(58) Field of Classification Search
USPC ..... 440/53, 75, 76, 78, 83, 84, 86
See application file for complete search history.

(56) References Cited

U.S. PATENT DOCUMENTS

| | | | | |
|---|---|---|---|---|
| 2011/0217886 | A1 | 9/2011 | Kuriyagawa et al. | |
| 2014/0045393 | A1 | 2/2014 | Kuriyagawa et al. | |
| 2015/0367924 | A1* | 12/2015 | Davis | B63H 20/08 440/53 |
| 2016/0023737 | A1* | 1/2016 | Davis | B63H 20/32 440/53 |

OTHER PUBLICATIONS

International Search Report filed in corresponding PCT Application No. PCT/EP2018/051492 dated Apr. 13, 2018.
German Search Report filed in corresponding German Application No. 10 2017 203 385.1 dated Mar. 16, 2018.

* cited by examiner

TRANSMISSION FOR A MARINE OUTBOARD PROPULSION SYSTEM

This application is a national stage completion of PCT/EP2018/051492 filed Jan. 23, 2018 which claims priority from German Application Serial No. 10 2017 203 385.1 filed Mar. 2, 2017.

FIELD OF THE INVENTION

The present invention concerns a transmission for a marine outboard propulsion system which enables at least two forward gears and one reverse gear and a corresponding marine outboard propulsion system.

BACKGROUND OF THE INVENTION

Usual marine outboard propulsion systems comprise a transmission, which is interposed between a combustion engine and a propeller shaft to change the output speed of the combustion engine and to transmit it to the propeller shaft.

Such a transmission is described in US 2014/0045393 A1. This transmission comprises an input shaft to be connected to the combustion engine and a countershaft which is arranged parallel to the input shaft. The transmission is further equipped with three pairs of gears to transmit the rotation of the input shaft to the countershaft. Switching elements are provided to selectively engage said gears to enable two forward gear ratios and one reverse gear ratio. The countershaft in this transmission serves as output shaft as well and transmits the power and rotation to a propeller shaft.

Essential for transmissions in marine outboard propulsion systems are generally small dimensions in order to enable compact overall dimensions of the propulsion system. Other aims are high functionality and reliability of the transmission and the outboard propulsion system.

Another marine outboard propulsion system with forward and reverse gear ratios provided by a relatively small dimensioned transmission is described in US 2009/0163094 A1. The straight-lined propulsion train from the vertically arranged crank shaft of the engine through the planetary gear train down to a bevel gear mechanism allows a slim and compact arrangement of the whole propulsion system. However, the transmission in this outboard propulsion system comprises a planetary gear train which is generally more complex in structure and less energy efficient compared to a countershaft transmission. Moreover the vertical dimensions of the outboard propulsion system with a planetary gear train are still quite extensive. A pump drive mechanism for a cooling water pump is arranged above the transmission which enlarges the vertical dimensions of this marine outboard propulsion system further.

SUMMARY OF THE INVENTION

An object of the present invention is therefore to provide a transmission for a marine outboard propulsion system which enables at least two forward speed gears and one reverse gear. The transmission shall enable a corresponding marine outboard propulsion system with small overall dimensions and with high efficiency, functionality and reliability.

These objects are attained by the present invention. The present invention provides a transmission for a marine outboard propulsion system, comprising an input shaft to be connected to an engine and a countershaft which is arranged parallel to the input shaft. Several pairs of gears are provided to transmit the rotation of the input shaft to the countershaft and switching elements are provided to selectively engage the gears to enable at least two forward gear ratios and one reverse gear ratio. Said switching elements can for example include one or more friction clutches. Such friction clutches can be used to connect an idler gear to the shaft on which is rotatably arranged in order to transmit driving torque through said gear and shaft. Typically such a friction clutch can be a multi-disk clutch.

The transmission according to the invention further comprises an output shaft which is arranged coaxial to the input shaft and a PTO countershaft which is adapted to drive at least one PTO-aggregate (Power-Take-Off assembly). PTO is a well-known technical term and means power-take-off. Coaxial arrangement of the input shaft and output shaft in the transmission enables a straight-lined arrangement of the propulsion train from a vertically arranged crankshaft of the combustion engine via the input and output shaft to a bevel gear unit which transmits the rotation to a horizontally arranged propeller shaft.

The PTO countershaft as part of the transmission provides a highly integrated functionality of the transmission. Said PTO-aggregate can be any type of aggregate, for example a water pump for cooling or a hydraulic oil pump for steering or other purposes. The PTO countershaft as part of the transmission enables the compact overall dimensions of the marine outboard propulsion system, because there is no need to arrange a PTO drive mechanism at any other position at the marine outboard propulsion system. The transmission can include a housing to encase at least partially the input shaft, the countershaft, the PTO countershaft, the output shaft, the pairs of gears and the switching elements. Said shafts being supported in the housing, for example by means of ball and/or roller bearings.

Hence, one idea of the present invention is to create a transmission for a marine outboard propulsion system wherein the available space in a housing is efficiently utilized.

A further space-saving design of the transmission can be reached, when the PTO countershaft is arranged parallel to the input shaft. The drive torque can be transmitted by one or several pairs of spur wheels to the PTO countershaft. Advantageous gear ratios for specific applications of the corresponding PTO-aggregate can be achieved by selecting appropriate pairs of spur wheels driving the PTO countershaft.

Preferably the transmission comprises a first PTO drive shaft which is coupled to the PTO countershaft by means of a first bevel gear mechanism, so that the first PTO drive shaft is positioned perpendicular to the PTO countershaft. The corresponding PTO-aggregate can be driven via the PTO countershaft and the first PTO drive shafts. A first PTO-aggregate may be positioned and driven directly adjacent to the transmission.

Additionally to the first PTO drive shaft, the transmission may comprise a second PTO drive shaft which is coupled to the PTO countershaft by means of a second bevel gear mechanism, so that the second PTO drive shaft is positioned perpendicular to the PTO countershaft, as well. Via the second PTO drive shaft a second PTO-aggregate can be driven. The second bevel gear mechanism can be positioned on the PTO countershaft with an axial offset to the first bevel gear mechanism. Such an arrangement enables a horizontal arrangement of the first and second PTO drive shaft, one above the other. The terms horizontal and vertical refer to a marine outboard propulsion system mounted to a boat and in operating position, with the water surface as a horizontal plane. The term axial in this document refers to the direction of the rotation axis of the input shaft, unless stated otherwise.

First and second PTO drive shafts may extend from the corresponding first or second bevel gear mechanism inside the housing through a wall of the housing to the outside. The first and/or second PTO-aggregate can be fixed to the housing of the transmission.

According to another preferred embodiment of the invention the transmission comprises a reverse gear shaft which is arranged parallel to the input shaft and which is in a constant driving connection with the input shaft. The reverse gear shaft can be driven by the input shaft by a pair of spur gears, wherein each of the two spur gears of this pair of spur gears is fixed to the corresponding shaft. The PTO countershaft can be in constant driving connection with the reverse gear shaft, thus achieving a constant driving connection between the input shaft and the PTO countershaft. This way it is ensured that the PTO-aggregate will be driven as soon as the engine of the marine outboard propulsion system is running.

In order to achieve a further improved compact design of the transmission, a first disc carrier of a first friction clutch can be fixed to the input shaft and a reverse disc carrier of a reverse friction clutch can be fixed to the reverse gear shaft. A first reverse gear can be rigidly fixed to the first disc carrier and constantly meshing with a second reverse gear which can be rigidly fixed to the reverse disc carrier.

In this embodiment preferably the first reverse gear can be formed integrally with the first disc carrier and/or the second reverse gear can be formed integrally with the reverse disc carrier. This way the disc carriers have a double function, namely their original function of carrying the discs of the corresponding clutch and additionally serving as gears for the reverse gear.

Beside the first friction clutch there can be arranged a second friction clutch at the input shaft for realizing first and second gear ratios by means of one pair of gears for each gear ratio.

Another aspect of the invention is related to a common parts concept, which means that several identical parts can be used in the transmission. This helps to fulfill low cost requirements due to lower production and storage costs. For this purpose the transmission can comprise a first fixed gear which is rotationally fixed to the countershaft. The first fixed gear is constantly meshing with a first idler gear mounted on the input shaft and with a reverse idler gear mounted on the reverse gear shaft. The first idler gear can be used to transmit power to the first fixed gear when a first forward gear is engaged by rotationally coupling said first idler gear to the input shaft. This can be done by means of the first friction clutch. The reverse idler gear can be used to transmit power to the first fixed gear when the reverse gear is engaged by rotationally couple said reverse idler gear to the reverse gear shaft. This can be done by means of the reverse friction clutch. Using the first fixed gear for the reverse gear and for the first forward gear saves a separate fixed reverse gear on the countershaft, helping thereby to fulfill narrow space requirements and saving costs by the use of identical parts for the first idler gear and the reverse idler gear.

The present invention covers further a marine outboard propulsion system comprising an engine, a transmission as described above and a first hydraulic pump drivable connected to the first PTO-drive shaft of the transmission. Such system preferably being further equipped with a second hydraulic pump drivable connected to the second PTO drive shaft of the transmission. The first hydraulic pump can for example be a steering pump to pivot the propeller shaft in order to adjust the propeller thrust direction. The second pump can be a water pump for cooling of the components of the marine outboard propulsion system.

BRIEF DESCRIPTION OF THE DRAWINGS

The following detailed description of a preferred embodiment of the invention in connection with the accompanying drawings will help to understand the objects, features and advantages of the invention, wherein.

DETAILED DESCRIPTION OF THE INVENTION

Figure 1:
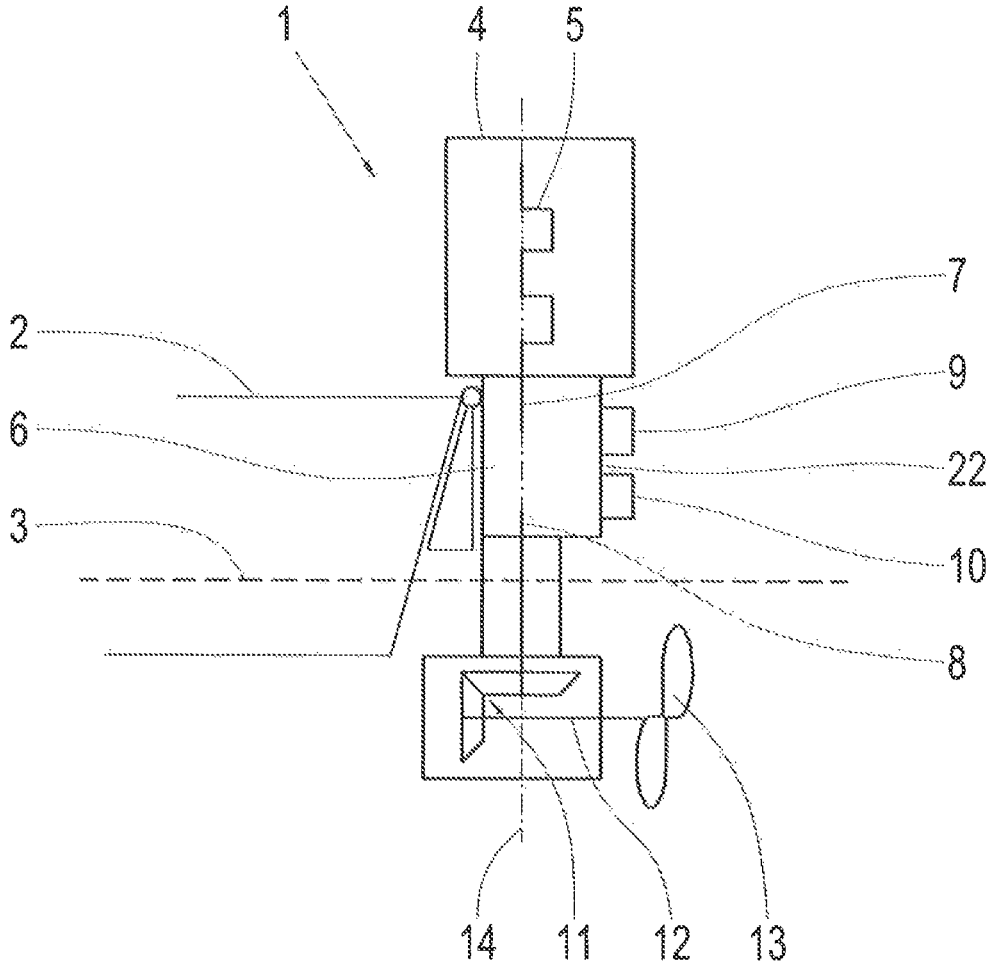
FIG. 1 shows a schematic plan of a marine outboard propulsion system according to the invention.

FIG. 1 shows a marine outboard propulsion system 1 which is mounted at the stern of a boats hull 2 in its operating position, with the water surface 3 as a horizontal plane. The marine outboard propulsion system 1 comprises a combustion engine 4 with a vertically oriented crankshaft 5. Crankshaft 5 is connected to an input shaft 7 of the transmission 6 which is located beneath the engine 4.

In another embodiment the engine 4 and the transmission 6 must not be directly adjacent to each other. There might be other parts of the propulsion system positioned between the engine and the transmission.

Via an output shaft 8 the power is transmitted to a lower bevel gear 11, which drives a horizontally oriented propeller shaft 12 with the propeller 13. The input shaft 7 enters the housing 22 on its upper side and the output shaft 8 leaves the housing 22 on its lower side. The crankshaft 5, the input shaft 7 and the output shaft 8 are all positioned coaxially to each other in a vertical axis 14. This way a relatively slim design of the marine outboard propulsion system 1 is achieved. Attached to a housing 22 of the transmission 6 there are two PTO aggregates 9 and 10.

Figure 2:
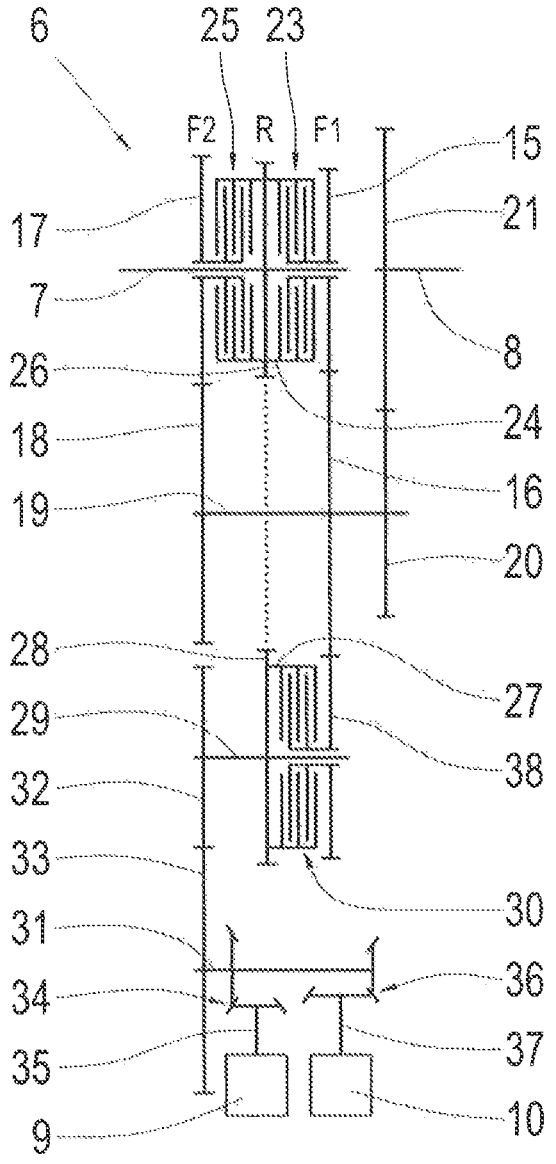
FIG. 2 shows a schematic plan of a transmission for a marine outboard propulsion system according to the invention.

FIG. 1 shows only the housing 22, the input shaft 7, output shaft 8 and the first and second PTO-aggregate 9 and 10 of the transmission 6. Other elements of the transmission 6 are shown in FIG. 2 and described in the following.

A first idler gear 15 and a second idler gear 17 are rotatably supported on the input shaft 7. First idler gear 15 is meshing permanently with a first fixed gear 16 which is fastened to a countershaft 19 and second idler gear 17 is meshing permanently with a second fixed gear 18 which is also fastened to countershaft 19. Hence, the first idler gear 15 together with the first fixed gear 16 form a first pair of gears and the second idler gear 17 together with the second fixed gear 18 form a second pair of gears. The first pair of gears 15, 16 has a different gear ratio than the second pair of gears 17, 18 in order to establish a first and a second forward gear F1, F2 with different ratios.

Countershaft 19 is arranged parallel to the input shaft 7. A third fixed gear 20 is also fastened to the countershaft 19 and in permanent meshing contact with a fourth fixed gear 21 which is fastened to output shaft 8. Output shaft 8 is arranged coaxially to the input shaft 7.

A first friction clutch 23 and a second friction clutch 25 are arranged as switching elements on the input shaft 7 to enable the selection of a first and a second forward gear ratio. A first disc carrier 24 is fixed to the input shaft 7 and carries outer discs of the first and second friction clutch 23, 25 which are both formed as multi-disk clutches.

The transmission 6 comprises further a reverse gear shaft 29 which is arranged parallel to the input shaft 7 and which is in a constant driving connection with the input shaft 7.

A first reverse gear 26 is rigidly arranged at the outer side of the first disc carrier 24 and constantly meshing with a second reverse gear 28 which is rigidly arranged at the outer side of a reverse disc carrier 27. Said constant meshing between the first reverse gear 26 and the second reverse gear 28 is indicated in FIG. 2 by a dashed line between the two gears 26 and 28.

The reverse disc carrier 27 is fixed to the reverse gear shaft 29 and is part of a reverse friction clutch 30. Hence, overall the transmission comprises three switching elements in form of friction clutches 23, 25 and 30 to selectively engage gears to enable two forward gear ratios and one reverse gear ratio. The first reverse gear 26 is formed integrally with the first disc carrier 24 and the second reverse gear 28 is formed integrally with the reverse disc carrier 27. A reverse idler gear 38 can be connected to the reverse gear shaft 29 by closing the reverse friction clutch 30. The reverse idler gear 38 is constantly meshing with first fixed gear 16 and so in constant driving connection with the countershaft 19 and the output shaft 8. Using the first fixed gear 16 for the reverse gear and for the first forward gear saves a separate fixed reverse gear on countershaft 19 helping thereby to fulfill narrow space requirements.

The transmission comprises further a PTO countershaft 31 which is arranged parallel to the input shaft 7. The PTO countershaft 31 located inside the housing 22 and in a constant driving connection with the input shaft 7 via the reverse gear shaft 29. For this a fifth fixed gear 32 which is fastened to the reverse gear shaft 29 is permanently meshing with a sixth fixed gear 33 which is fastened to the PTO countershaft 31.

The PTO countershaft 31 drives the first PTO-aggregate 9 and the second PTO-aggregate 10. The first PTO-aggregate 9 is driven via a first bevel gear mechanism 34 and first PTO drive shaft 35 while the second PTO-aggregate 10 is driven via a second bevel gear mechanism 36 and second PTO drive shaft 37. Each of the first and second bevel gear mechanisms 34 and 36 comprises a pair of bevel gears. Advantageous gear ratios for specific applications of the corresponding PTO-aggregate 9, 10 can be achieved by selecting appropriate pairs of bevel gears 34, 36 driving the corresponding PTO drive shaft 35, 37.

Figure 3:
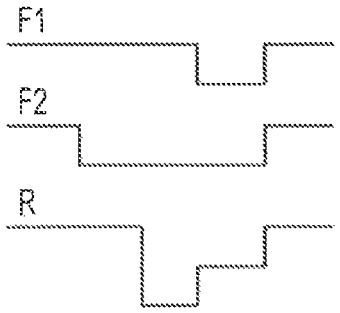
FIG. 3 shows a schematic power flow diagram of the transmission in FIG. 2

The power flow diagram of FIG. 3 shows the power flow from the input shaft 7 to the output shaft 8 in the three different gears, namely the first forward gear F1 second forward gear F2 and reverse gear R.

In order to engage the first forward gear F1 the first friction clutch 23 is closed while the second friction clutch 25 and the reverse friction clutch 30 are open. In this case the power flows from the input shaft 7 via the first friction clutch 23, first idler gear 15, first fixed gear 16, countershaft 19, third fixed gear 20 and fourth fixed gear 21 to the output shaft 8.

In order to engage the second forward gear F2 the second friction clutch 25 is closed while the first friction clutch 23 and the reverse friction clutch 30 are open. In this case the power flows from the input shaft 7 via the second friction clutch 25, second idler gear 17, second fixed gear 18, countershaft 19, third fixed gear 20 and fourth fixed gear 21 to the output shaft 8.

In order to engage the reverse gear R the first friction clutch 23 and the second friction clutch 25 are open while the reverse friction clutch 30 is closed. In this case the power flows from the input shaft 7 via the first reverse gear 26, second reverse gear 28, reverse clutch 30, reverse idler gear 38, first fixed gear 16, countershaft 19, third fixed gear 20 and fourth fixed gear 21 to the output shaft 8.

Figure 4:
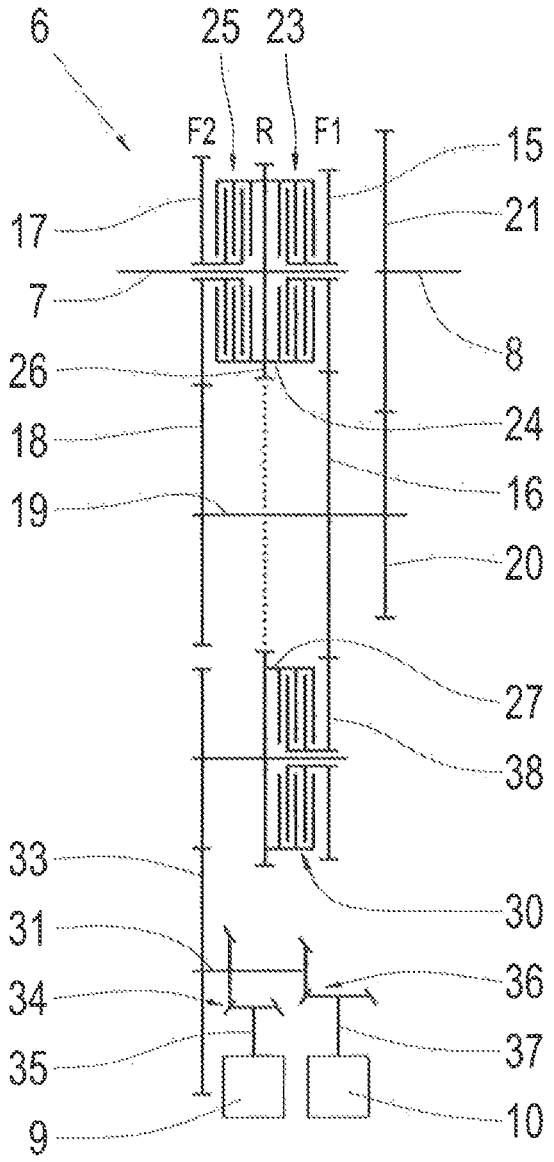
FIG. 4 shows a schematic plan of the transmission in FIG. 2 with a different arrangement of the bevel gear mechanisms at the PTO drive shafts.

The transmission 6 shown in FIG. 4 is very similar to transmission 6 shown in FIG. 2. That is why the same elements of the transmission have the same reference number in FIG. 2 and FIG. 4. The only difference of the transmission 6 in FIG. 4 is the arrangement of the bevel gear mechanisms 34 and 36 at the PTO counter shaft 31. By interchanging the drive side of the driving bevel gear related to the driven bevel gear at one or both bevel gear mechanisms 34, 36 the direction of rotation of the corresponding PTO drive shaft 35, 37 can be changed.

REFERENCE NUMERAL

1 marine outboard propulsion system
2 hull
3 water surface
4 engine
5 crankshaft
6 transmission
7 input shaft
8 output shaft
9 PTO-aggregate
10 PTO-aggregate
11 lower bevel gear
12 propeller shaft
13 propeller
14 vertical axis
15 first idler gear
16 first fixed gear
17 second idler gear
18 second fixed gear
19 countershaft
20 third fixed gear
21 fourth fixed gear
22 housing
23 first friction clutch
24 first disc carrier
25 second friction clutch
26 first reverse gear
27 reverse disc carrier
28 second reverse gear
29 reverse gear shaft
30 reverse friction clutch
31 PTO-counter shaft
32 fifth fixed gear
33 sixth fixed gear
34 first bevel gear mechanism
35 first PTO drive shaft
36 second bevel gear mechanism
37 second PTO drive shaft
38 reverse idler gear
F1 first forward gear
F2 second forward gear
R reverse gear

The invention claimed is:

1. A transmission, for a marine outboard propulsion system, comprising:

an input shaft for connection to an engine, a countershaft being arranged parallel to the input shaft, several pairs of gears for transmitting rotation of the input shaft to the countershaft, and switching elements for selectively engaging gears to enable at least two forward gear ratios and one reverse gear ratio, wherein the transmission comprises an output shaft which is arranged coaxial to the input shaft and a power take-off countershaft adapted to drive at least one power take-off assembly, and the transmission comprises a reverse gear shaft which is arranged parallel to the input shaft and which is in a constant driving connection with the input shaft, and the power take-off countershaft is in a constant driving connection with the reverse gear shaft.

2. The transmission according to claim 1, wherein the power take-off countershaft is arranged parallel to the input shaft.

3. The transmission according to claim 1, wherein the transmission comprises a first power take-off drive shaft which is coupled to the power take-off countershaft by a first bevel gear mechanism.

4. The transmission according to claim 3, wherein the transmission comprises a second power take-off drive shaft which is coupled to the power take-off countershaft by a second bevel gear mechanism.

5. The transmission according to claim 1, wherein a first disc carrier of a first friction clutch is fixed to the input shaft and a reverse disc carrier of a reverse friction clutch is fixed to the reverse gear shaft, a first reverse gear is rigidly arranged at the first disc carrier and constantly meshing with a second reverse gear which is rigidly arranged at the reverse disc carrier.

6. The transmission according to claim 5, wherein at least one of:

the first reverse gear is formed integrally with the first disc carrier, and/or the second reverse is formed integrally with the reverse disc carrier.

7. The transmission according to claim 5, wherein the transmission comprises a first fixed gear which is rotationally fixed to the countershaft, and the first fixed gear constantly meshes with a first idler gear mounted on the input shaft and with a reverse idler gear mounted on the reverse gear shaft.

8. A marine outboard propulsion system, comprising:

an engine, a transmission comprising:

an input shaft for connection to an engine, a countershaft being arranged parallel to the input shaft, several pairs of gears for transmitting rotation of the input shaft to the countershaft, and switching elements for selectively engaging gears to enable at least two forward gear ratios and one reverse gear ratio, wherein the transmission comprises an output shaft which is arranged coaxial to the input shaft and a power take-off countershaft adapted to drive at least one power take-off assembly, and the transmission comprises a reverse gear shaft which is arranged parallel to the input shaft and which is in a constant driving connection with the input shaft, the power take-off countershaft is in a constant driving connection with the reverse gear shaft, and a first hydraulic pump being drivable connected to a first power take-off drive shaft.

9. The marine outboard propulsion system according to claim 8, wherein the marine outboard propulsion system further comprises a second hydraulic pump drivable connected to a second power take-off drive shaft.

10. A transmission, for a marine outboard propulsion system, comprising:

an input shaft for connection to an engine, a countershaft being arranged parallel to the input shaft, at least two pairs of gears for transmitting rotation of the input shaft to the countershaft, and at least two switching elements for selectively engaging gears to enable at least two forward gear ratios and one reverse gear ratio, wherein the transmission comprises an output shaft which is arranged coaxial to the input shaft and a power take-off countershaft adapted to drive at least one power take-off assembly, and the transmission comprises a reverse gear shaft which is arranged parallel to the input shaft and which is in a constant driving connection with the input shaft, and the power take-off countershaft is in a constant driving connection with the reverse gear shaft.

* * * * *